United States Patent [19]

Ecer

[11] Patent Number: 4,533,004

[45] Date of Patent: Aug. 6, 1985

[54] SELF SHARPENING DRAG BIT FOR SUB-SURFACE FORMATION DRILLING

[75] Inventor: Gunes M. Ecer, Irvine, Calif.

[73] Assignee: CDP, Ltd., Newport Beach, Calif.

[21] Appl. No.: 570,860

[22] Filed: Jan. 16, 1984

[51] Int. Cl.[3] ..... E21B 10/46

[52] U.S. Cl. ..... 175/329; 175/379

[58] Field of Search ..... 175/329, 336, 379, 409

[56] References Cited

U.S. PATENT DOCUMENTS

| | | | |
|---|---|---|---|
| 2,234,273 | 3/1941 | Pennington | 175/379 |
| 2,888,247 | 5/1959 | Haglund | 175/379 |
| 2,889,138 | 6/1959 | Haglund | 175/379 |
| 4,225,322 | 9/1980 | Knemeyer | 175/329 |
| 4,359,335 | 11/1982 | Garner | 175/379 |
| 4,460,053 | 7/1984 | Jürgens et al. | 175/329 |
| 4,465,148 | 8/1984 | Morris et al. | 175/329 |

*Primary Examiner*—Stephen J. Novosad
*Assistant Examiner*—William P. Neuder
*Attorney, Agent, or Firm*—William W. Haefliger

[57] ABSTRACT

A self-sharpening rotary drag bit assembly comprises:

(a) a carrier body adapted to be rotated about a first axis, and having a drilling end, (b) cutters carried by the body to be exposed for cutting at the drilling end of the body, the cutters having thereon layers of hard materials defining cutting edges to engage and cut the drilled formation as the body rotates, the cutters also including reinforcement material supporting said layers to resist deflection thereof under cutting loads, (c) said body and said reinforcement material being characterized as abradable by the formation as the bit drilling end rotates in engagement with the formation.

29 Claims, 10 Drawing Figures

SELF SHARPENING DRAG BIT FOR SUB-SURFACE FORMATION DRILLING

BACKGROUND OF THE INVENTION

This invention relates generally to rock bits used in earth drilling for mining, the drilling of oil, gas and geothermal wells, and construction drilling; more specifically, it provides self-sharpening drag bits to be used for such drilling.

Rock bits are the most crucial components of earth drilling systems, as they do the actual cutting. Their performance determines the length of time it takes to drill to a given depth, thus, the efficiency of the drilling operation is largely dependent on the efficiency of such bits. Conventional bits are generally designed with three cone-shaped wheels, called "cones", with hardened steel teeth or carbide teeth for cutting the rock. For drilling very hard formations, a special bit with a diamond-studded face often replaces the tricone roller bit. The cones serve as cutters and utilize carbide or hardened steel teeth as the cutting elements. As the bit rotates, the cones roll around the bottom of the hole, each cutting element intermittently penetrating into the rock, crushing and chipping it. The cones are designed so that the teeth intermesh to facilitate cleaning. Drilling fluid pumped through cone nozzles carries away the cuttings.

Inasmuch as such drilling occurs in very harsh environments and under heavy loads, wear and tear effects of the rock formation on the bit are tremendous. The bit, therefore, must have an extremely durable mechanism and be made of materials that can withstand erosion and wear in places where the bit contacts the rock, such as the outside surface of the cones. In this regard, excessive erosion of the cone surface may cause cutting elements to fall off.

Cones rotate around a rugged set of bearings which, in most applications, must be protected from rock cuttings by a seal and lubricated for better performance. Excessive wear of either the seal or the bearings results in loss of the sealing function, and can quickly lead to premature bit failure. In carbide tipped bits, the cutting elements consist of tungsten carbide inserts and are press fitted into precisely machined holes drilled around the cone. The dimensions of the holes and the inserts must be precisely matched. If the fit is too tight, the insert or the cone may be damaged; if it is too loose, the inserts will fall off during drilling.

Similar requirements exist for milled tooth bits, except that in this case the cutting elements are teeth-machined from the cone body. Parts of the teeth are hardfaced, by welding a harder alloy layer to the surface to impart resistance to wear. This welded layer is usually non-uniform in thickness and composition. In most cases, portions of the cone surface are hardened by carburizing, which may last typically 10–20 hours at high temperatures affecting the properties of the whole part. Bearings are inlayed by welding or the bearing races are either carburized or boronized, which again require long thermal treatments. As the cutting elements wear, cutting efficiency decreases until the rate of penetration is too slow to economically justify further drilling. Then, the bit is pulled out and replaced. Raising and lowering of the drill string, called tripping, is a costly operation which may be reduced by extending the drill bit life and improving the efficiency of drilling.

The cutting elements on rollerbits begin to lose their sharpness soon after drilling begins. This shortcoming has been addressed by utilizing polycrystalline diamond drag bits or "PDC" drag bits for short. Major drawbacks of PDC drag bits include their inability to drill hard formations due to chipping and breakage of the diamond compacts, the high cost of the bit, and the excessive body erosion which may lead to cutter loss.

Deficiencies of existing rock bits include:

(1) Performance in roller bits depends on perfect working of several interdependent components. These are:

a bearings system
a cutting structure
a sealing mechanism
a lubrication system

Failure of any one of these affects the others, and leads to premature bit failure.

(2) Cutting efficiency is compromised due to several state-of-the-art necessities, listed as follows:

(a) Inserts have to be press fitted, a precise yet still imperfect practice for carbide tipped roller bits;
(b) Long thermal treatments, such as carburizing, can produce metallurgical side effects and distortion;
(c) Hardfacing of milled steel teeth rarely produces a uniform deposit, both in dimensional or chemical points of view;
(d) Bearing inlays too, are chemically non-uniform, thus, inherently weak.

(3) Undesirably excessive machining and dimensional inspection require high labor use, and therefore result in high manufacturing cost.

(4) In all existing bit designs, the cutting elements represent only a small proportion of the total bit structure. When cutting elements wear out, the entireties of the bits become useless. Furthermore, in roller bits, especially, cutting elements dull quickly, resulting in a steady drop-off in drilling efficiency.

(5) In roller bits, the cutting structure has to fit into a limited space. This space is shared by the cones and the journal pins. Design changes based on increase in volume of both of these two components are impossible. Any volume change of one has to be made at the expense of the other. This limitation does not exist for drag bits.

SUMMARY OF THE INVENTION

It is a major object of the invention to provide an improved self-sharpening drag bit characterized as overcoming the problems and difficulties referred to above. Basically, the drag bit assembly comprises (a) a carrier body adapted to be rotated about a first axis, and having a drilling end, (b) cutters carried by the body to be exposed for cutting at the drilling end of the body, the cutters having thereon layers of hard material defining cutting edges to engage and cut the drilled formation as the body rotates, the cutters also including reinforcement material supporting said layers to resist deflection thereof under cutting loads, (c) said body and said reinforcement material being characterized as abradable by the formation as the bit drilling end rotates in engagement with the formation.

As will be seen, the layers defining the cutting edges are sufficiently thin as to be self-sharpening, in use; the reinforcement material, of lesser hardness (or wear resistance) than that of the cutting layers, is located at the rotary rear sides of the self-sharpening layers; and the bit body material carrying the layers and reinforcement material is of still lesser hardness, whereby the self-sharpening action occurs as the bit wears away, in the direction of the bit axis of rotation. In this regard, the cutters are elongated in direction generally parallel to that axis and extend into the body material, for support.

Thus, the cutting elements remain sharp and are continually replenished. The bits have no moving parts, such as bearings or cones, and require only a minimal machining.

These and other objects and advantages of the invention, as well as the details of an illustrative embodiment, will be more fully understood from the following description and drawings, in which.

DETAILED DESCRIPTION

Figure 1:
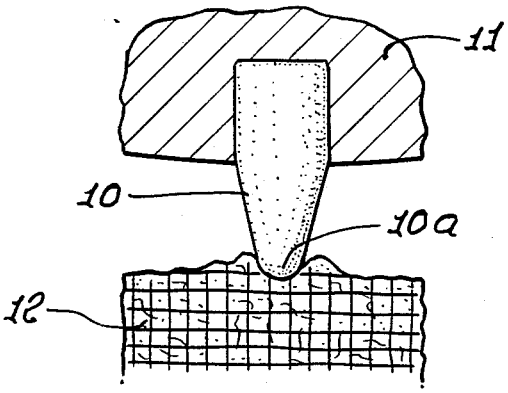
FIG. 1 is an enlarged section taken through a rolling cone bit insert.

Referring first to FIG. 1, it shows a conventional tungsten carbide insert 10 in a rollerbit steel cone body 11, with the tip 10*a* of the insert engaging the rock formation at 12. The insert crushes the rock formation as the rollerbit rotates.

Figure 2:
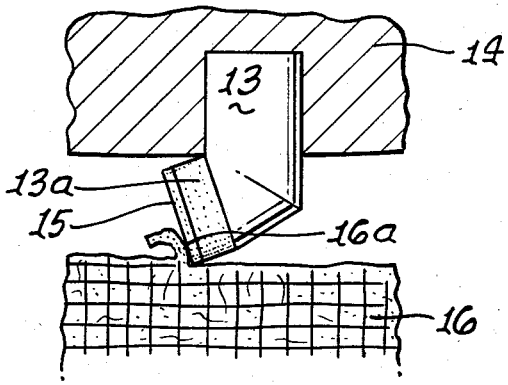
FIG. 2 is an enlarged section taken through a polycrystalline diamond compact bit.

FIG. 2 shows an insert 13 in a bit body 14, and including a tungsten carbide offset 13*a* carrying a PDC layer 15. The latter comprises a polycrystalline diamond cutter shearing the formation rock 16 at 16*a*. Because shearing requires less energy than crushing, the FIG. 2 PDC bits are more efficient than the FIG. 1 bits.

Figure 3:
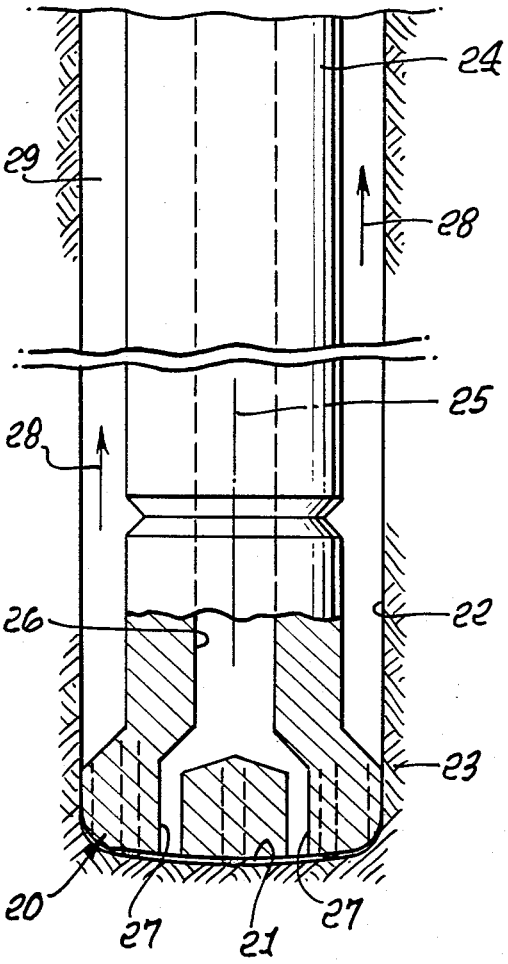
FIG. 3 is an elevation showing drilling utilizing a bit in accordance with the present invention.

FIG. 3 shows a bit 20 constructed according to the present invention, and engaging the bottom hole face 21 in a drilled hole 22 in formation 23. The bit 20 is carried by a rotary drill string 24, and has an axis of rotation 25. Drilling fluid (for example mud) is pumped down the bore 26 of the tubular string, to pass through nozzles 27 in the bit and exit at face 21, for lubricating the cutters as they rotatably drag across the face 21, and for carrying the cuttings upwardly, see arrow 28 in the annulus 29.

Figure 4:
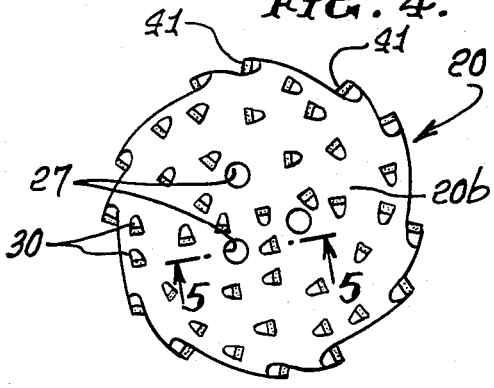
FIG. 4 is a bottom view of a self-sharpening bit of the present invention.
Figure 5:
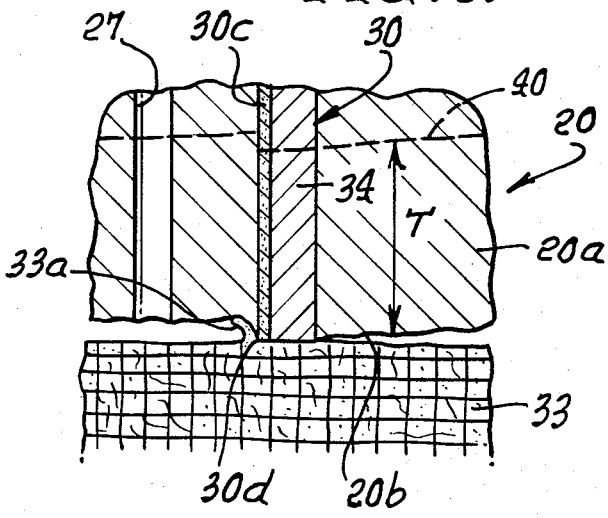
FIG. 5 is an enlarged section, in elevation and on lines 5—5 of FIG. 4, showing drag cutter construction, and cutting operation.

As shown in FIGS. 4 and 5, multiple cutters 30 are carried by the bit body 20*a* to be exposed for cutting the formation at the drilling end 20*b* of the bit body. The cutters are spaced apart radially and generally circularly, along with nozzles 27, within the matrix material of the bit body in such manner as to have no rings of uncut formation on the hole bottom, as the bit rotates. Considering a radial sequence of concentric zones on the bit bottom, there are increasing numbers of cutters located in the zones of increasing diameter, i.e. away from center, so as to sustain generally uniform bit wear during drilling.

Referring to FIG. 5, the cutters 30 are elongated, generally parallel to axis 25 and extend from within the body material to and through the body cutting end 20*b*, for exposure to the formation 33. Each cutter has thereon a longitudinally extending layer 30*c* of hard material defining a cutting edge 30*d* to engage and cut the formation (see cutting 33*a* being formed), as the bit rotates.

The cutters also include reinforcing material 34 supporting the layers 30*c*, to resist deflection and break-off of the latter, under encountered cutting loads. The body 20*a* and reinforcement material 34, are characaterized as abradable by the formation, as the bit rotates, and the layer 30*c* is sufficiently thin, whereby the cutting layer is self-sharpening, at edge 30*d*.

Typically, the thin layer 30*c* is made of very hard substance, such as tungsten carbide, silicon nitride or diamond, to act as the cutting edge supported by a strong material 34 such as steel. The hardness, or more precisely, the wear resistance of the thin hard layer is superior to that of the steel support, and the steel, in turn, is superior in hardness to the matrix alloy 20 in terms of wear. Cutters need only protrude slightly, since small layers of the formation are sheared off.

Matrix 20, being an easily-wearing material, recedes by erosion due to impact of the rock particles and the high-pressure flow of the drilling mud continually exposing new cutter sections as they wear. The thin, hard layer of the cutter 30*c* wears the least, so it will always be flush with the supporting steel 34 and provide a sharp cutting edge 30*d* throughout drilling. See broken line 40 in FIG. 5, showing the bottom face of the bit, and cutter 30, after bit extent T is abraded.

If the matrix alloy wears excessively, more volume thus created between the bit and the formation lowers the fluid pressure there, reducing erosion, thus self-regulating the erosion process. The cuttings and the mud will rise up along the side of the bit in channels such as are indicated at 41 in FIG. 4. Excessive erosion of the channels can be prevented by a wear-resistant alloy layer on the latter.

Accordingly, erosion at the bit bottom face, instead of being a problem, becomes a useful part of the drilling mechanism. Since the cutters can be of selected length, drilling depth with one single self-sharpening bit, can be selected. Also, no bearings or seals are required, so the bits can be rotated at very high speeds increasing the rate of penetration, requiring less weight on bit, and improving the ability to drill straight holes. Cutter chipping is not a problem, as only a small portion of cutter layer tip 30*d* is exposed and needed for cutting.

The cutters are produced either separately or simultaneously with the bit body. Methods suitable to produce both the cutters and the bit body include casting, brazing, powder metal consolidation. With regards to the last method, hot isostatic pressuring in autoclaves or in hot presses utilizing ceramic grains as the pressure transmitting media may be used, hot pressing being the preferred method due to its ability to consolidate by a short time, high temperature cycle. It is desirable that the metal powder consolidated body retain porosity in an amount up to 20% of the body overall volume.

Bit geometries and shapes, cutter size, number and distribution are established based on known design criteria. It is preferred, however, that the cutters have a thin layer (preferably less than one-eighth of an inch) of a very hard substance such as carbides, nitrides, oxides and borides or their mixtures or solutions of the following elements: silicon, titanium, tungsten, hafnium, vanadium, boron, aluminum, or any other compound with a hardness higher than 1000 kg/mm$^2$ hardness and thermally stable at least up to 1000 degrees Fahrenheit. Furthermore, these compounds may be mixed or in solution with each other.

These refractory hard compounds may be in any suitable form, i.e., granular, strip, wire coated layer, and may be bound by another material such as cobalt, nickel, iron or copper, or their alloys.

Diamond, both synthetic or natural, may replace the above hard compounds. In this case, the diamond may be either in a polycrystalline layer form (produced by high temperature-high pressure sintering) or as particles bonded together by a binder compound that may consist of metal carbides, oxides, nitres or borides and any of their mixtures or solutions, the metal selected from the group that includes tungsten, molybdenum, silicon, aluminum, titanium and hafnium; further the total amount of binder being up to 50% by weight of the total weight of the hard layer. The binder may also contain metals from the group that includes cobalt, iron, nickel, copper, and alloys thereof.

The support member 34 for the cutter may consist of an alloy, cemented carbide, (such as cobalt cemented tungsten carbide) oxide or nitride or a material whose tensile strength is above 70,000 psi with impact strength higher than that of the hard cutting layer 30*a* and whose wear resistance is lower than the layer 30*c* described above.

Bit matrix material may consist of a material having a wear resistance lower than that of the cutting element materials. It may be cast, sintered, or melt infiltrated, and may have pores constituting up to 20% of its volume.

The self-sharpening bit may be constructed to provide a sufficiently rigid skelton grouping of cutters, so as not to require the additional support of the matrix material. In such cases no "easy wearing matrix alloy" would be required. The rigidity to the cutting elements network may then be provided as described below.

Figure 6:
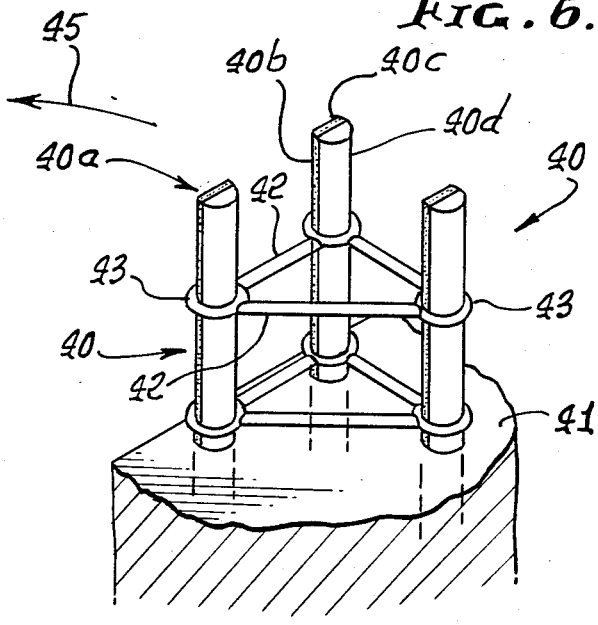
FIG. 6 is a perspective view of an integrated cutter group.

FIG. 6 shows a group of parallel elongated cutters 40 carried by a bit body 41, as for example by embedding lower ends of the cutters in the body material. The cutters protrude from the body, and are interconnected by reinforcement struts 42 tying the cutters together. Annular supports 43 may be located about the cutters, and the struts 42 may be connected to the supports 43, as shown. The assembly 40, 42 and 43 may be embedded in the softer material of the body 41, or may protrude therefrom. Cutting ends of the cutters appear at 40*a*. Each cutter may include a layer of hard material 40*b* defining a cutting edge 40*c*, and reinforcment material 40*d* adjacent to and supporting the layer 40*b*. The bit may be made up of several such cutter groups, carried by the body 41. Cutter travel is in direction 45.

Figure 9:
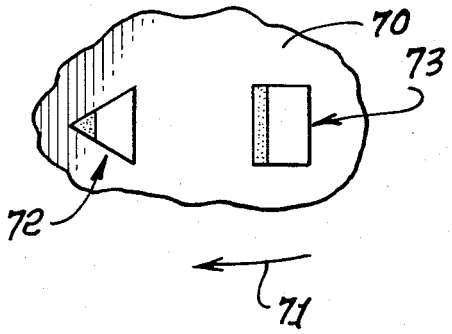
FIGS. 8 and 9 are cross sections showing cutter configurations.
Figure 7:
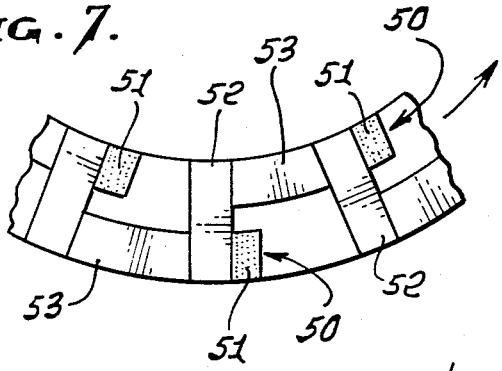
FIG. 7 is a fragmentary section showing modified cutter reinforcement.
Figure 8:
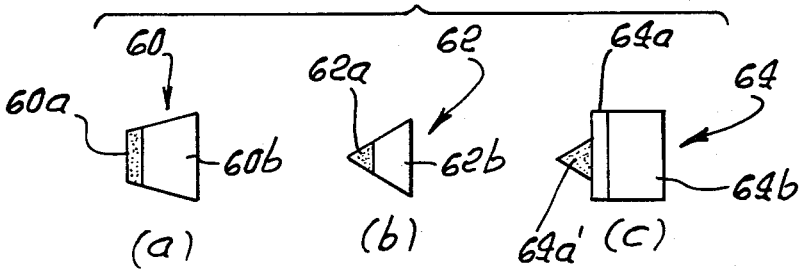

FIG. 7 is an end view of a series of annularly arranged cutters 50, each of which includes a hard cutting layer 51 backed up by an adjacent rib of reinforcing material 52. The latter ribs are annularly spaced, and additional reinforcing struts 53 extend circularly between the ribs to provide additional reinforcement. Note that the struts 53 extend rearwardly of the cutter layers, to transfer load from the ribs 52 to the next rearward ribs. FIG. 8 shows different cutter cross sections, in end view. Fig. 8(*a*) shows a trapezoidal cutter 60 made up of narrow hard layer 60*a* backed up by wider reinforcement layer 60*b*; FIG. 8(*b*) shows a triangular cutter 62 having a narrow pointed hard layer 62*a* backed up by wider reinforcing layer 62*b*; and FIG. 8(*c*) shows a composite cutter 64 having a flat hard layer 64*a* with a triangular forward nose 64*a*', and backed up by an adjacent reinforcing layer 64*b*. FIG. 9 shows a bit body 70 rotating in direction 71, and carrying cutters such as a triangular cross-section cutter 72 (in end view) preceding a rectangular cutter 73. The cutter 72 is like cutter 62; and cutter 73 is like cutter 64 except that no hard nose 64*a*' is used, although it could be used.

Figure 10:
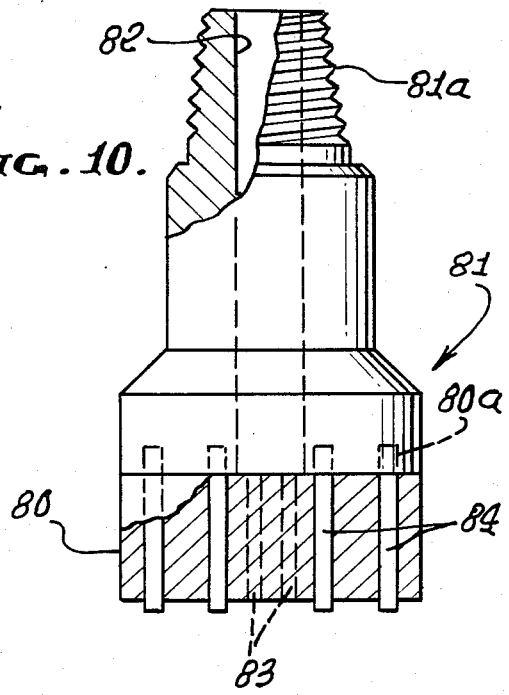
FIG. 10 is an elevation showing a modified bit construction

FIG. 10 shows a "consumable" bit body 80 (similar to one of the bodies 20*c*, 41, 53 and 70) and attached to a permanent steel base 81 having a threaded pin end 81*a*. The latter is connectible to drill pipe. Axial openings in the pipe, and at 82 in the base 81, flow drilling fluid to the smaller channels 83 in the consumable material 80 which wears away during drilling, as described in connection with FIGS. 3–5. Elongated cutters 84 are embedded in the material 80, and also have ends anchored at 80*a* to the base 81, as by welding them into recesses in the latter.

In FIG. 5, the thickness of layer 30*c* is less than about 0.040 inch.

I claim:

1. A self sharpening rotary drag bit assembly, comprising (a) a carrier body adapted to be rotated about a first axis, and having a drilling end, (b) cutters carried by the body to be spaced from one another and to be exposed for cutting at the drilling end of the body, the cutters having thereon layers of hard material defining cutting edges to engage and cut the drilled formation as the body rotates, the cutters also including reinforcement material supporting said layers to resist deflection thereof under cutting loads, (d) said cutters being elongated in directions generally parallel to said axis, and extending individually in said body to be separated by body material, and to project at the cutting end of the body, (e) the hardness of said layers exceeding the hardness of said reinforcement material, and the hardness of said reinforcement material exceeding the hardness of said body at the drilling end thereof, (f) whereby the hard material continually presents a cutting edge to the formation as the hard material, said reinforcing material, and said body abrade simultaneously, axially, during cutting.

2. The drill bit assembly of claim 1 wherein said layers are sufficiently thin as to be self-sharpening.

3. The drill bit of claim 1 wherein the material of said hard layers is selected from the group that includes tungsten carbide, silicon nitride, and diamond.

4. The drill bit assembly of claim 1 wherein said reinforcement material consists of steel and is located at the rotary rearward sides of said layers.

5. The drill bit assembly of claim 1 wherein said cutters are distributed across the cutting end of said body.

6. The drill bit of claim 1 including drilling fluid ducts in said body and opening at the body exterior.

7. The combination of claim 1 wherein the drilling end of the body is characterized by generally concentric zones about said axis, the numbers of cutters in said concentric zones increasing, radially outwardly from said axis.

8. The combination of claim 1 including longitudinally elongated channels at the side of the bit, and via which cuttings and drilling fluid may rise past the bit to flow upwardly in the annulus about the drilling string.

9. The combination of claim 1 wherein said body consists of consolidated metal powder in which said cutters are embedded.

10. The combination of claim 9 wherein said metal powder consolidated body retains porosity up to 20% of its volume.

11. The combination of claim 1 wherein said hard layers have thickness less than about $\frac{1}{8}$ inch.

12. The drill bit assembly of claim 1 wherein said cutters are elongated in direction generally parallel to said axis, and including strut means interconnecting the cutters.

13. The combination of claim 12 wherein said cutters and struts project from the body.

14. The combination of claim 12 wherein said cutters and struts are substantially completely embedded in said body.

15. The combination of claim 12 wherein the reinforcing material defines radially extending webs, and said strut means includes struts extending rearwardly of the hard material layers and joined to the reinforcing material of successive cutters.

16. The combination of claim 1 wherein the cutters have trapezoidal cross sections, the hard material layers located at the narrow sides of the cross sections.

17. The combination of claim 1 wherein the cutters have triangular cross sections, the hard material layer located at one tip of each triangular cross section.

18. The combination of claim 1 wherein the cutters have rectangular cross sections, the hard material layers located at one side of each rectangular cross section.

19. The combination of claim 18 wherein the hard material layers including tapered noses.

20. The combination of claim 1 wherein the bit includes a supporting base joined to the abradable body, the base having a threaded portion attachable to a drill string.

21. The combination of claim 20 wherein the cutters are anchored to the base.

22. The combination of claim 20 wherein the cutters have longitudinal axes extending at 0° to 30° relative to the bit axis.

23. The combination of claim 1 wherein the material of the hard layers is selected from the group that includes carbides, nitrides, oxides, and borides of the elements silicon, titanium, hafnium, vanadium, boron, and aluminum, and has a hardness in excess of 1,000kg/mm$^2$ and is thermally stable at temperature less than 1,000° F.

24. The combination of claim 1 wherein the reinforcement material consists of cobalt cemented tungsten carbide.

25. The combination of claim 1 wherein the material of said hard layers consists substantially of natural or synthetic diamond in polycrystalline compact form, or in the form of granules mixed and bound together by a metallic binder.

26. The combination of claim 25 wherein the metallic binder is selected from the group that includes cobalt, iron, nickel, copper and alloys thereof.

27. The combination of claim 26 wherein the metallic binder also includes carbides, oxides or nitrides of a metal or metals selected from the group that includes tungsten, molybdenum, silicon, aluminum, titanium and hafnium, the total amount of said binder being up to 50% by weight of the weight of said hard layer.

28. The assembly of claim 1 wherein each other includes multiple layers of said hard material, said reinforcement material being less hard than said hard material, and the hardest layer of said multiple layers being located at the rotary forward side of the cutter and providing a cutting edge.

29. The assembly of claim 28 wherein the thickness of said hardest layer is less than 0.040 inch.

* * * * *